US005234783A

United States Patent [19]

Ng

[11] Patent Number: 5,234,783

[45] Date of Patent: Aug. 10, 1993

[54] METHOD OF SELECTIVELY GLOSSING TONER IMAGES

[75] Inventor: Yee S. Ng, Fairport, N.Y.

[73] Assignee: Eastman Kodak Company, Rochester, N.Y.

[21] Appl. No.: 808,706

[22] Filed: Dec. 16, 1991

[51] Int. Cl.[5] ..... G03G 13/08

[52] U.S. Cl. ..... 430/45; 430/97; 430/120

[58] Field of Search ..... 430/45, 97, 120

[56] References Cited

U.S. PATENT DOCUMENTS

| | | | |
|---|---|---|---|
| 4,040,828 | 8/1977 | Evans | 430/45 X |
| 4,740,818 | 4/1988 | Tsilibes et al. | 355/771 |
| 4,820,618 | 4/1989 | Lawson et al. | 430/45 |
| 4,828,950 | 5/1989 | Crandall | 430/45 |

FOREIGN PATENT DOCUMENTS

| | | | |
|---|---|---|---|
| 25215 | 6/1984 | Japan | 430/45 |
| 25216 | 6/1984 | Japan | 430/45 |

OTHER PUBLICATIONS

Xerox Disclosure Journal, vol. 16, No. 1, Jan./Feb. 1991, p. 69.

Japanese Patent Appln. 133422/87, Laid-Open 300254/88, Dec. 7, 1988.

*Primary Examiner*—Roland Martin

*Attorney, Agent, or Firm*—Leonard W. Treash, Jr.

[57] ABSTRACT

A toner image that combines pictorial information with text or graphic information is made glossy only in the pictorial portion. A clear gloss enhancing toner is selectively applied to the portion of the image that is pictorial as determined by a suitable manual input or electronic analysis of the image.

10 Claims, 4 Drawing Sheets

METHOD OF SELECTIVELY GLOSSING TONER IMAGES

TECHNICAL FIELD

This invention relates to toner image formation and finishing. It is particularly useful in forming multicolor toner images, especially in systems which combine text or graphics on the same image or sheet with pictorial subject matter, especially color pictorial subject matter.

BACKGROUND ART

Early electrophotographic copiers used a hard metallic fusing roller covered with a fluorocarbon which imparted an undesirably glossy finish to what was nearly 100% textural material. Later copiers used a silicone rubber fusing roller which provided a more matte finish to the text which generally has been considered more desirable.

As electrophotography has become more and more capable of reproducing pictorial subject matter, especially in three or four colors, a desire for a more glossy appearance has been felt. Accordingly, hard metallic fusing surfaces are used and toners are formulated and designed for glossy reproduction for image forming apparatus designed for color pictures. At the same time, office copiers dealing primarily with textural material or graphics continue to prefer a more matte finish.

As apparatus of both types becomes more flexible, pictorial subject matter is more and more being mixed with text and graphics in essentially the same image. Desk top publishing systems are quite capable of combining a scanned color pictorial image with text or graphics from a different source. It has been suggested that the use of black toners which are formulated to give a matte finish in combination with color toners formulated to produce a glossy finish will provide both a matte finish for text and a glossy finish for pictorials at the same fusing conditions of heat and pressure. If undercolor removal is used in the pictorials, black is laid down first and hopefully completely covered by the glossier color toner for most of a pictorial image. See, for example, Japanese Patent Appl. 133422/87, Laid-Open No. 300254/88, Dec. 7, 1988.

If a glossy toner is fused to a less glossy receiving sheet the amount of gloss may vary imagewise, giving an undesirably uneven appearance. It has been suggested that a clear, glossy toner can be added either uniformly or imagewise across the top of a multicolor toner image to increase the gloss of the image. The clear toner can be laid down in an image configuration which will even the height of the toner and the qloss of the image already there or it can be laid down evenly. See, for example, *Xerox Disclosure Journal.* Volume 16, No. 1, January/February 1991, page 69; and U.S. Pat. No. 4,828,950 issued to R. P. Crandall, May 9, 1989.

The choice between matte, silk or glossy images in conventional photography has been largely considered one of choice to the consumer. That choice is provided in photofinishing by imparting a particular texture or gloss to photographic paper in its manufacture which is eventually imparted to the image after printing.

DISCLOSURE OF THE INVENTION

It is an object of the invention to provide a method of producing toner images having portions of varying texture or gloss This and other objects are accomplished by determining or defining a portion of an image that is to be of a different gloss or texture than the rest of the image and producing a toner image on a receiving sheet which toner image includes a gloss or texture varying toner selectively positioned in the defined or determined portion.

According to a preferred embodiment, an operator of a printer or a copier determines which portion of an image the operator wishes to have at a higher gloss, for example, a color pictorial portion. The location of that pictorial portion is input to the copier or printer which creates an image of a gloss enhancing toner corresponding to that portion. That particular image is superposed on the rest of the toner image or images thereby producing an image having a gloss that varies at least according to the presence of the gloss producing toner image.

With this method the operator can decide to make glossy a color pictorial portion of an image and leave as a matte finish, text or graphics, whatever the color of the text or graphics.

According to a further preferred embodiment an image may be analyzed electronically utilizing known characteristics that differentiate a pictorial portion from a graphic or alphanumeric portion Utilizing that information, a gloss or texture varying toner can be applied selectively to automatically gloss the pictorial portion of the image while leaving unglossed the text or graphics.

According to another preferred embodiment, a gloss enhancing toner can be applied imagewise in the pictorial portion of the image to even the gloss and height of the image in the pictorial region while leaving the text of graphics with a more textured finish. It may even be advantageous to apply glossy transparent toner to a low density region of a pictorial halftone so that differential gloss between a high density and low density region can be reduced.

Another advantage of selective application of transparent glossing toner is that it does not necessarily increase the toner fusing mass to be higher than that of a regular four-color image.

BRIEF DESCRIPTION OF THE DRAWINGS

In the detailed description of the preferred embodiment of the invention presented below, reference is made to the accompanying drawings, in which.

BEST MODES OF CARRYING OUT THE INVENTION

Figure 1:
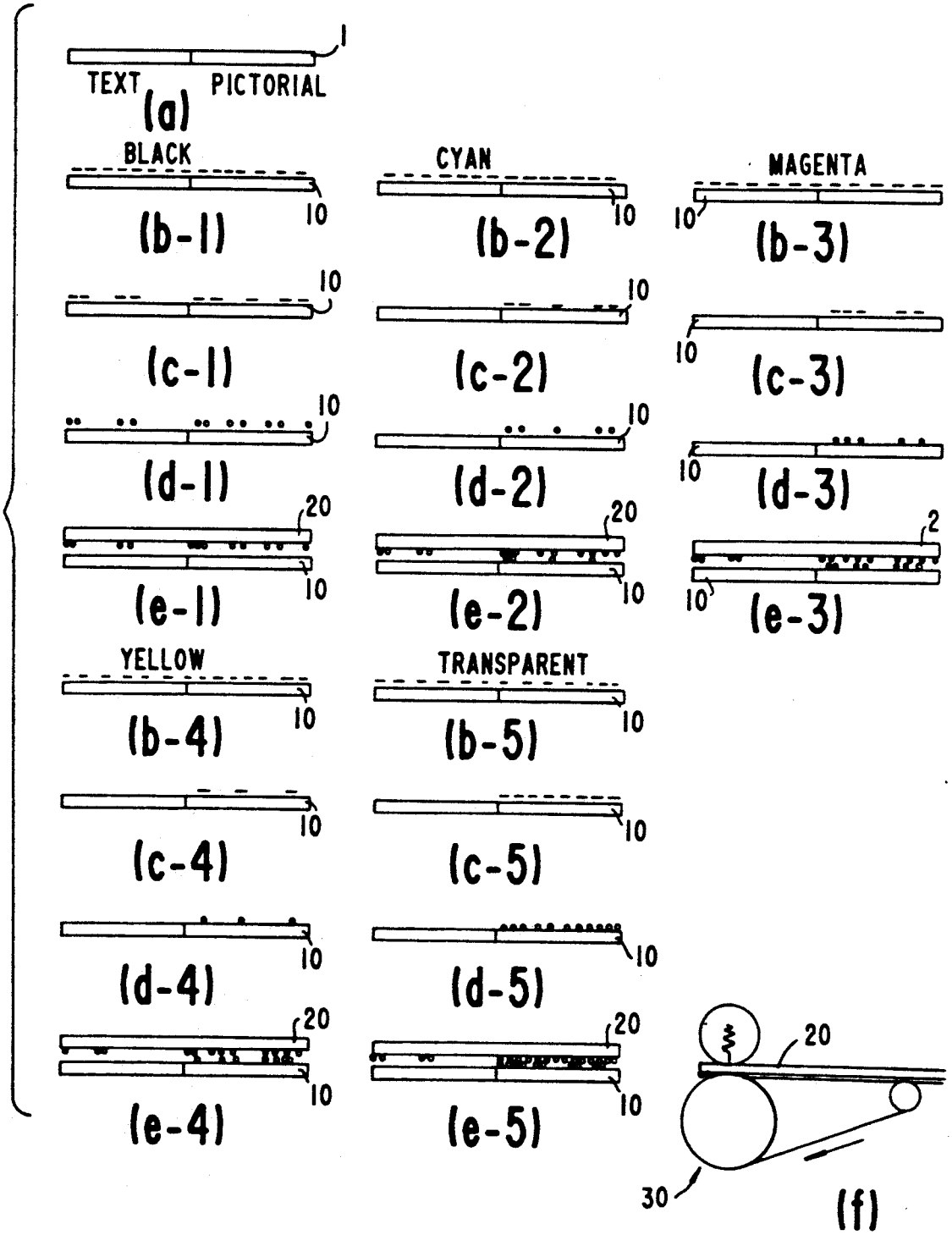
FIG. 1 is a graphic illustration of a method of making a multicolor image having different levels of gloss according to the invention as depicted in a series of steps designated from (a) to (f).

One embodiment of the invention is illustrated in FIG. 1 in which an original which is schematically illustrated at 1 in step (a) includes both text and pictorial information. It is desirable to reproduce the pictorial information as a glossy multicolor image while reproducing the text in a matte finish. The text may be any one or more colors, but in FIG. 1 is illustrated as black.

An image member, for example, a photoconductive element 10 is uniformly charged as shown at (b-1), imagewise exposed to form an electrostatic image shown at (c-1) representative of the black content of original 1. This black content can include text or graphics in the left portion of the electrostatic image as seen in FIG. 1 and the black component of the pictorial portion of the original as seen on the right side of the electrostatic image. The black component of the pictorial portion can be the result of an undercolor removal process well known in the imaging arts which substitutes black for a portion of the image made up of cyan, magenta, and yellow colors. The electrostatic image shown in (c-1) is developed by the application of a black toner to create a black toner image corresponding to the electrostatic image and as shown in (d-1). According to (e-1) the toner image is transferred to a receiving sheet 20.

This process is repeated utilizing cyan, magenta and yellow toners to further complete the representation of original 1. Cyan is illustrated in steps (b-2) to (e-2), the magenta in steps (b-3) to (e-3) and the yellow in steps (b-4) to (e-4). At this point, receiving sheet 20 contains a multicolor image having black text in the left portion and multicolor pictorial subject matter in the right portion as seen in step (e-4).

According to the invention, a fifth image is created by again uniformly charging image member 10 as shown in step (b-5). In this embodiment, in step (c-5) the electrostatic image is determined or defined according to appropriate inputs representative of the portion which is pictorial and the portion which is text in the original. According to step (d-5) that electrostatic image is toned with a clear toner that produces a high gloss when subjected to ordinary fixing. That toner extends only over the pictorial portion of the image. According to step (e-5) the toner image formed in step (d-5) is transferred in registration to the receiving sheet 20 to create a toner image having graphics on the left portion and pictorial on the right but with the gloss producing or enhancing toner limited to the right portion of the image.

According to step (f) the receiving sheet 20 is passed through a fuser 30 which utilizes the application of pressure and heat to fix the image to the receiving sheet. Fusing is carried out at a temperature and pressure which causes the gloss producing toner to produce a high gloss in the pictorial portion of the image but which produces a matte finish in the text portion of the image.

Figure 2:
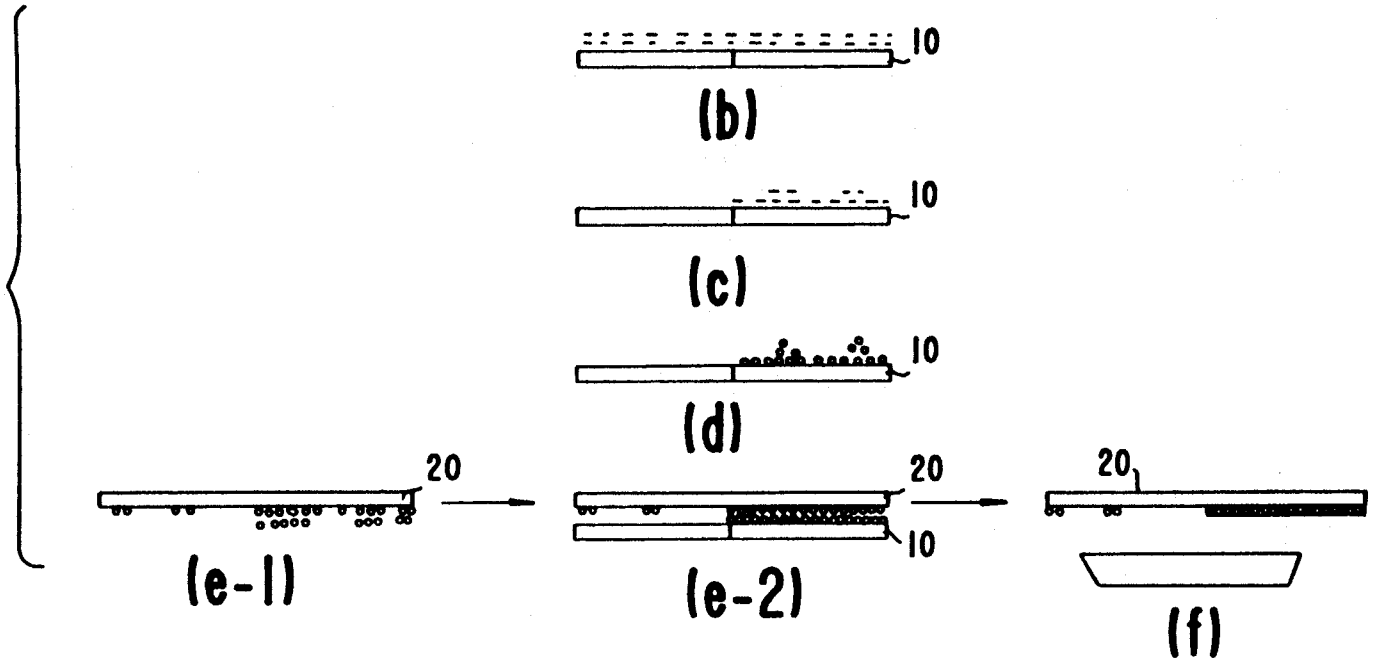
FIGS. 2 and 3 are similar to FIG. 1 but illustrate embodiments in which the FIG. 1 method has been modified.
Figure 3:
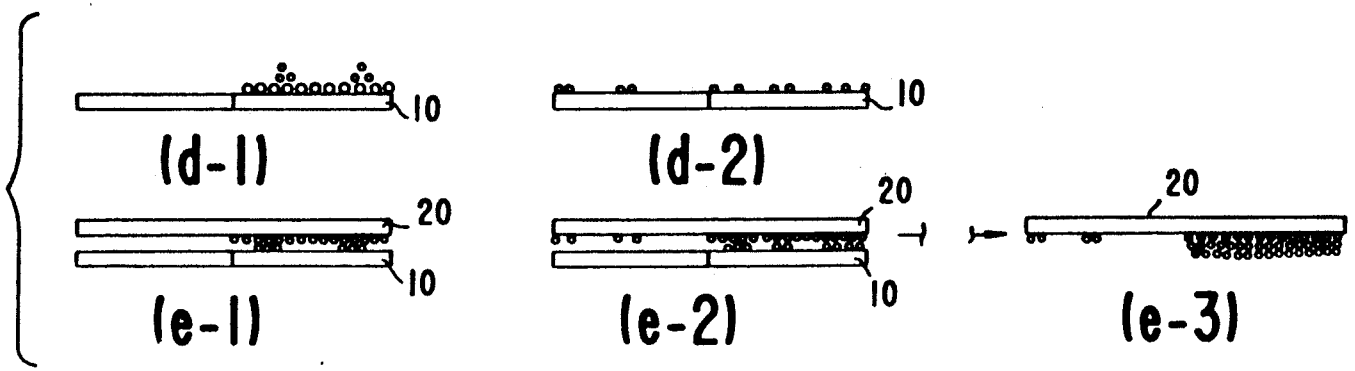

FIGS. 2 and 3 illustrate several other embodiments of the invention. According to FIG. 2 the glossing toner is laid down non-uniformly in the pictorial portion of the intended image. In this embodiment, the electrostatic image shown in step (c) is created to be the inverse of the pictorial portion of the toner image shown in step (e-1). When the electrostatic image is toned with a gloss providing toner in step (d) it provides more gloss providing toner in the non-image areas than in the image areas shown in step (e-1). The resulting toner image shown in step (e-2) is then uniform in height and gloss across the pictorial portion of the receiving sheet providing an even image height as shown after fusing in step (f). The even height is desirable in highest quality pictorial electrophotographic images.

According to FIG. 3 the gloss producing toner image is produced first and transferred to the receiving sheet before transfer of the other toner images. As shown in FIG. 3, a gloss producing toner image shown in step (d-1) is comparable to that shown in step (d) in FIG. 2 and varies inversely according to the expected height of the other images providing ultimately an even height toner image. Thus, the result shown in (e-5) of FIG. 3 is comparable to that shown in step (e-2) of FIG. 2 except that the gloss producing toner image is underneath the black and color toner images. The process shown in FIG. 3 could also be used to produce a uniform gloss producing toner layer in the pictorial portion of the image underneath the other toner images.

Putting the gloss producing toner image on as an undercoat as shown in FIG. 3 may provide differential gloss between high and low density regions, but it may be desirable for certain applications. However, it is generally preferred to put the gloss producing toner on as the last coat so that it does not in any way inhibit the transfer of the other four layers of toner and provides the greatest gloss for the pictorial portion of the final image.

Figure 4:
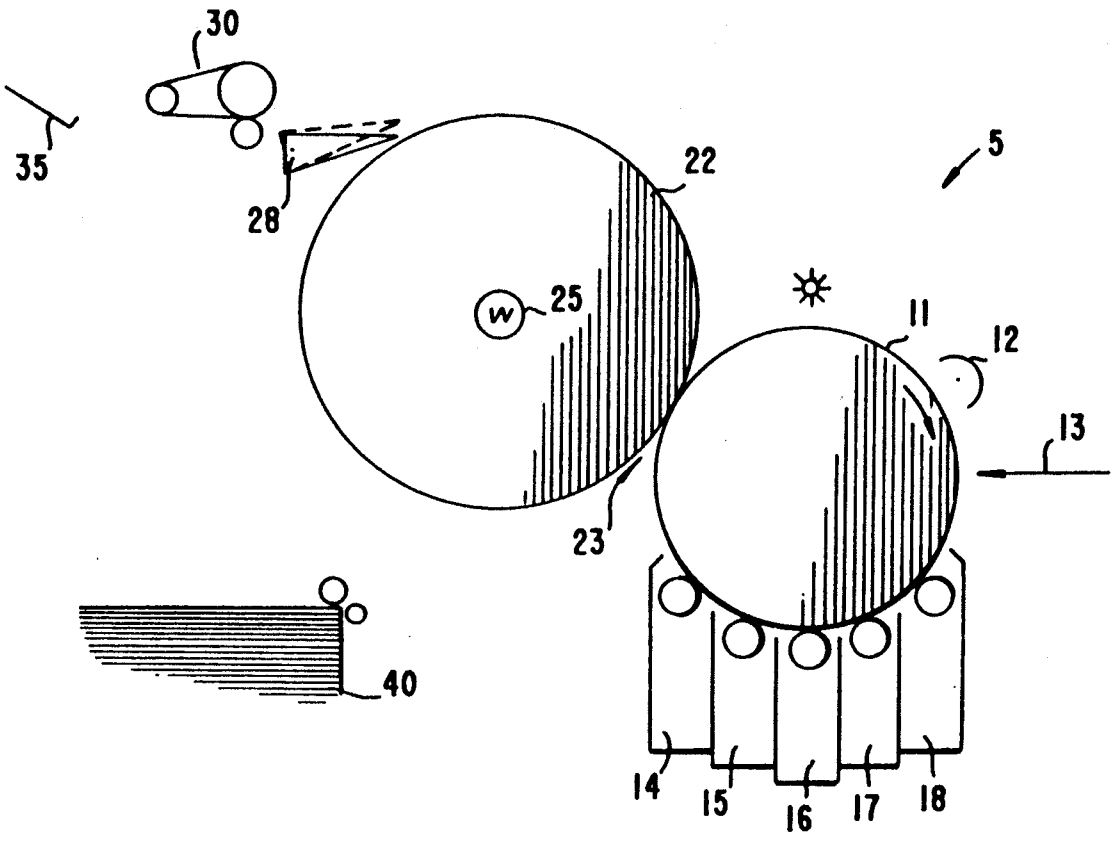
FIGS. 4 and 5 are front schematics of alternative apparatus for carrying out the methods illustrated in FIGS. 1-3.

FIG. 4 shows an image forming apparatus 5 for carrying out the method shown in FIGS. 1-3 According to FIG. 4, a photoconductive drum 11 is rotated past a series of well-known electrophotographic stations, including a charging station 12 which uniformly charges an image surface of drum 11. The uniformly charged image surface is imagewise exposed by a laser 13 or other similar exposing device, to create a series of electrostatic images on drum 11. Each electrostatic image is toned by one of development stations 14, 15, 16, 17 and 18 to create a series of toner images Following the process disclosed in FIG. 1, the first four images would be of black, cyan, magenta and yellow in that order. The fifth image would be an image of clear gloss producing toner toned with development station 18.

The images are transferred in registration to a receiving sheet, which receiving sheet has been fed from receiving sheet supply 40 onto the periphery of a transfer drum 22 where it is held by a vacuum, holding fingers or electrostatics, all as are well known in the art. The toner images are transferred in order to the receiving sheet, in registration, as the transfer drum rotates the receiving sheet through a nip 23 with photoconductive drum 11. Transfer can be by conventional electrostatics. However, for fine toners, it is preferable that heat transfer is used. Therefore, transfer drum 22 is heated internally by a lamp 25.

After all five toner images have been transferred in registration to the receiving sheet, the receiving sheet is separated from transfer drum 22 by an articulatable skive 28 which moves into position for this purpose. The receiving sheet is then fed through a fuser 30 and then into an output hopper 35.

Fuser 30 subjects the receiving sheet and the toner images to a combination of pressure and temperature which causes the images to fix to the receiving sheet. In general, the toners are fixed at a temperature such that the toners making up the text portion of the image will provide a matte appearance while at least the gloss producing toner will provide a glossy appearance where it exists. If it is assumed that the primary text and graphics will be accomplished by the black toner, the black toner can be a relatively low glossing toner providing a matte finish at the fusing temperature used. All of the other toners can be made to be relatively high glossing toners and the temperature of the fuser 30 can be picked such that each of the non-black toners contributes to the gloss of the pictorial portion of the image. However, an advantage of the invention is that not only can the black toner be a low glossing toner thereby providing a matte finish, but the magenta, cyan and yellow toners can also be low glossing toners. Thus, the text or graphic portion of the image can be any of these colors or a combination of them and still provide a matte finish while the pictorial portion of the image is glossy because of the gloss producing toner selectively positioned in that portion.

Figure 5:
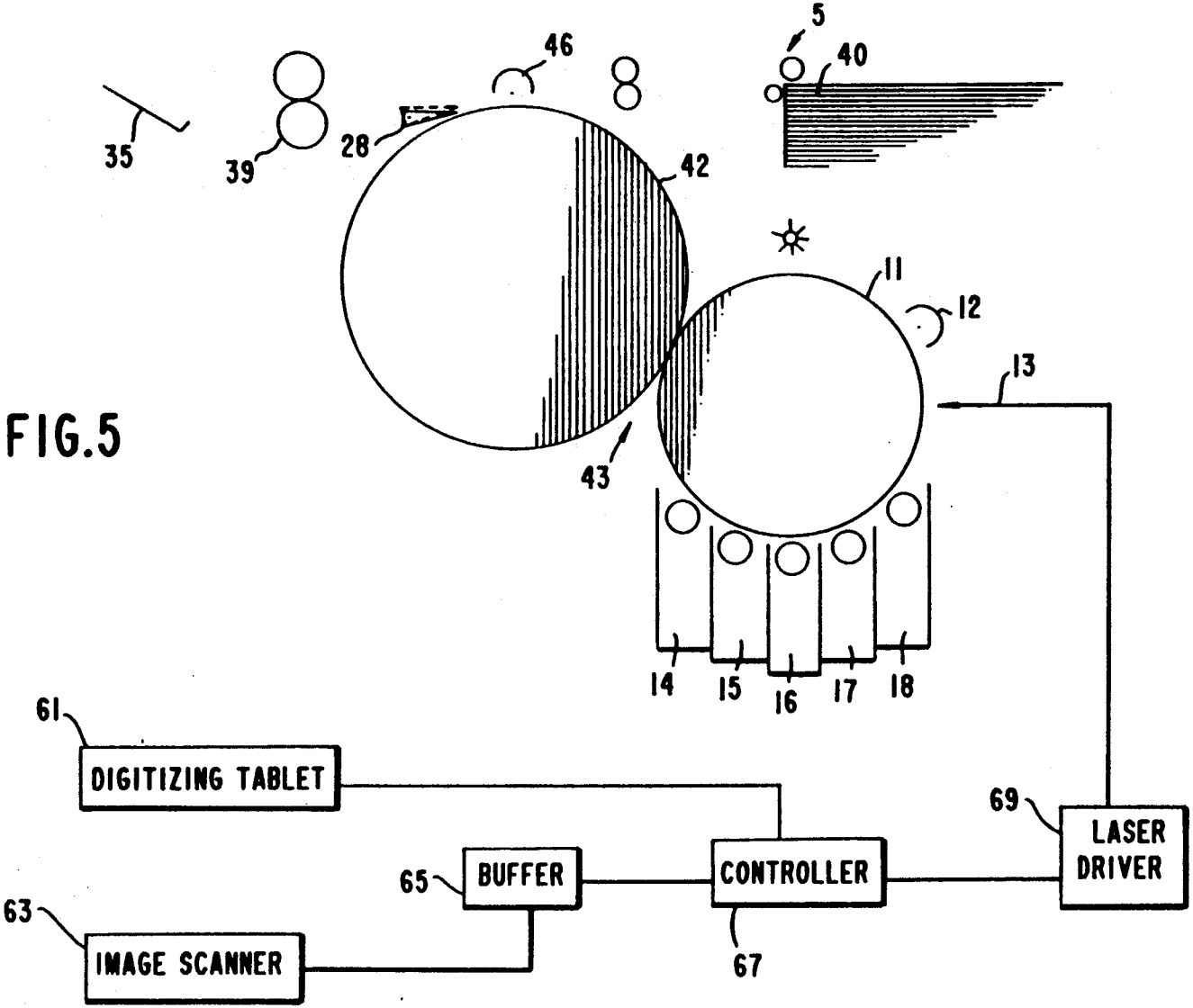

FIG. 5 shows an alternative embodiment similar in most respects to the FIG. 4 apparatus. According to FIG. 5 the toner images are created on a photoconductive drum 11 as in FIG. 4 except that the gloss producing toner image is created first and the black image is produced last. The images are then transferred in a transfer nip 43 directly to the outside surface of a transfer drum 42 in registration to create a multicolor image with the gloss producing toner image on the bottom and the black image on the top. This multicolor image is then transferred in one step to a receiving sheet fed from receiving sheet supply 40 to a transfer station 46. The receiving sheet is separated from drum 42 by a pawl or skive 28 and fed through fuser 39 to output tray 35 as in the FIG. 4 apparatus.

In the FIG. 5 embodiment the transfer drum 42 is an intermediate which accumulates the images in registration, allowing a straight paper path for the system and making registration of the images somewhat easier.

The determination of the portion of the image that is to be glossy can be done in a number of ways. For example, U.S. Pat. No. 4,740,818 granted Apr. 26, 1988 to Tsilibes et al, discloses the use of a digitizing tablet to designate pictorial portions of an original which pictorial portions then are treated differently, for example, by the application of a screen. This patent is incorporated by reference herein. It thoroughly discloses the use of a digitizing tablet for the operator to, by hand, input a portion of the original to be specially treated.

FIG. 5 schematically illustrates this preferred approach to determining the portion of the image to receive the glossing toner. A digitizing tablet 61 is used to designate a portion of an original to be copied. The original is then scanned by an input scanner 63 into a buffer or other memory. A controller 67 utilizes input from the digitizing tablet and the buffer to provide appropriate bit maps to a laser driver 69 which controls laser 13, one bit map for each color plus one for the gloss enhancing toner image.

However, as the special treatment of images has progressed, this type of improvement is best implemented using a work station suitable for desk top publishing. With such a work station, special treatment can be designated for different portions of an image and a scanned-in pictorial image combined with textural matter while viewing the image itself on a screen. Utilizing the software incorporated in such systems a bit map can be created corresponding to a uniform image across a pictorial region for carrying out the process of FIG. 1, or an image corresponding inversely to a combination of the other toner images created in the pictorial portion for carrying out the process disclosed in FIG. 2. For this latter, imagewise lay down of the gloss providing toner, see the disclosure of U.S. Pat. No. 4,828,950 granted to R. P. Crandall on May 9, 1989, which disclosure is also incorporated by reference herein.

For an explanation of the considerations in picking toners of low glossing characteristics and high glossing characteristics, reference is made to Japanese Laid Open application 300254/88, laid open Dec. 7, 1988, which is incorporated by reference herein. In general, toners having a relatively high viscosity at the fusing temperature provide a more desirable matte finish, for example, most cross-linking black toners presently used for copiers perform in this manner. These toners can be made in many colors and could be used for all four colors in the examples. Toners having a low viscosity at the fusing temperature provide a more glossy appearance and are commonly used in color apparatus. They include many polyester toners with these characteristics. For the glossing application set out herein, they are made without pigment.

Supplying varying amounts of gloss producing toner to even the toner height across the pictorial portion produces good results with fairly glossy color toners. However, with all four color toners of high viscosity, some gloss producing toner is desired across the whole image. For this reason, a uniform layer may be preferred in such applications. compromise approach is to apply a layer that varies according to height of stack, but does not eliminate the glossy toner at any spot.

The invention has been described in detail with particular reference to a preferred embodiment thereof, but it will be understood that variations and modifications can be effected within the spirit and scope of the invention as described hereinabove and as defined in the appended claims.

I claim:

1. A method of forming a toner image having visibly distinct segments of varying texture of gloss, from input image information, said method comprising:

defining a portion of the input image information corresponding to a distinct segment that is to be of higher gloss or less texture, and producing the toner image from the input image information on a receiving sheet, which toner image includes a clear gloss producing or texture reducing toner selectively in said visibly distinct segment.

2. A method of forming toner images having portions of varying textures or gloss, said method comprising:

determining a first portion of an image which contains pictorial subject matter and a second portion of an image which does not contain pictorial subject matter, producing a plurality of toner images on a receiving surface, said plurality of images including a toner image made up of a clear gloss enhancing toner, the gloss enhancing toner image conforming to the first portion of the image, superposing said toner images on a surface, and fixing said toner images to said surface.

3. The method according to claim 2 wherein the gloss enhancing toner image is varied across the pictorial portion of the image inversely according to the other of the plurality of images.

4. A method according to claim 3 wherein the gloss enhancing toner image is varied to level the height of the toner images in the pictorial portion of the superposed toner images.

5. A method of forming a toner image on a receiving sheet, which toner image includes a first portion which is primarily pictorial and a second portion of said image which is primarily text or graphics, said method comprising:

forming a series of electrostatic images, including at least first and second electrostatic images corresponding to different color components of the desired final image and a third image, corresponding to the first portion of the image, applying different color toner to said at least first and second electrostatic images to form different color toner images defined by the first and second electrostatic images, applying a low melting point gloss enhancing toner to said third electrostatic image to form a toner image corresponding to the first portion of the final toner image, and superposing said images in registration to create a multicolor image having increased gloss in the pictorial portion.

6. A method according to claim 5 including the step of varying the third image in said first portion inversely according to the density of at least one of the first and second toner images.

7. A method according to claim 5 wherein the third image is of uniform density across said first portion.

8. A method of forming a final toner image on a receiving sheet, which final toner image includes a first portion which is primarily pictorial and a second portion, said method comprising:

forming a series of five electrostatic images, the first four of said images corresponding to color information making up components of the desired final image and the fifth electrostatic image corresponding to the first portion of the final image, applying black, cyan, magenta and yellow toners to four of said electrostatic images, respectively, to form different color toner images, applying a transparent toner having a lower viscosity than at least said black toner to the fifth electrostatic image to create a toner image corresponding to the pictorial portion of the final image, superposing the five toner images in registration on a receiving sheet to form a multicolor toner image with a gloss enchancing toner in the pictorial portion, fixing said toner image to said receiving sheet under conditions of pressure and temperature providing a glossy appearance in the pictorial portion of the image and a less glossy appearance to the image in the non-pictorial portion.

9. The method according to claim 8 wherein said step of determining includes manually inputting data defining the first portion of said image.

10. The method according to claim 8 wherein said step of determining includes electronically analyzing said image in determining the first portion according to electronically analyzable characteristics thereof.

* * * * *

UNITED STATES PATENT OFFICE

CERTIFICATE OF CORRECTION

Patent No. 5,234,783 Dated August 10, 1993

Inventor(s) Yee S. Ng

It is certified that error appears in the above-identified patent and that said Letters Patent is hereby corrected as shown below:

Column 6, line 30 Delete "of" (second occurrence) and substitute ---or---.

Signed and Sealed this

Fifteenth Day of March, 1994

Bruce Lehman

*Attest:*

BRUCE LEHMAN

*Attesting Officer*

*Commissioner of Patents and Trademarks*